United States Patent [19]

Swinney

[11] 4,433,801

[45] Feb. 28, 1984

[54] PAINTER'S CADDY

[76] Inventor: Glen E. Swinney, Rte. 1, Box 234-A, Axton, Va. 24054

[21] Appl. No.: 364,877

[22] Filed: Apr. 2, 1982

[51] Int. Cl.[3] ..... A46B 17/00

[52] U.S. Cl. ..... 224/148; 224/268; 224/42.45 R

[58] Field of Search ..... 224/148, 224, 226, 247, 224/248, 250, 268, 269, 270, 282, 42.45 R, 42.46 R

[56] References Cited

U.S. PATENT DOCUMENTS

| | | | |
|---|---|---|---|
| 2,926,879 | 3/1960 | Dietrich | 224/42.45 R X |
| 2,985,349 | 5/1961 | McGuire | 224/268 |
| 3,285,482 | 11/1966 | Bedsaul, Sr. | 224/269 X |
| 3,493,152 | 2/1970 | Ort | 224/248 |
| 3,528,591 | 9/1970 | Von Herbulis | 224/42.46 R |
| 4,325,503 | 4/1982 | Swinney | 224/148 |

*Primary Examiner*—Steven M. Pollard

*Attorney, Agent, or Firm*—Roger L. Campbell

[57] ABSTRACT

A rack or holder for a paint bucket is linked to a belt-held member in a manner to permit movement about three axes all at right angles to one another so that the bucket is maintained in an upright position.

1 Claim, 3 Drawing Figures

FIG I
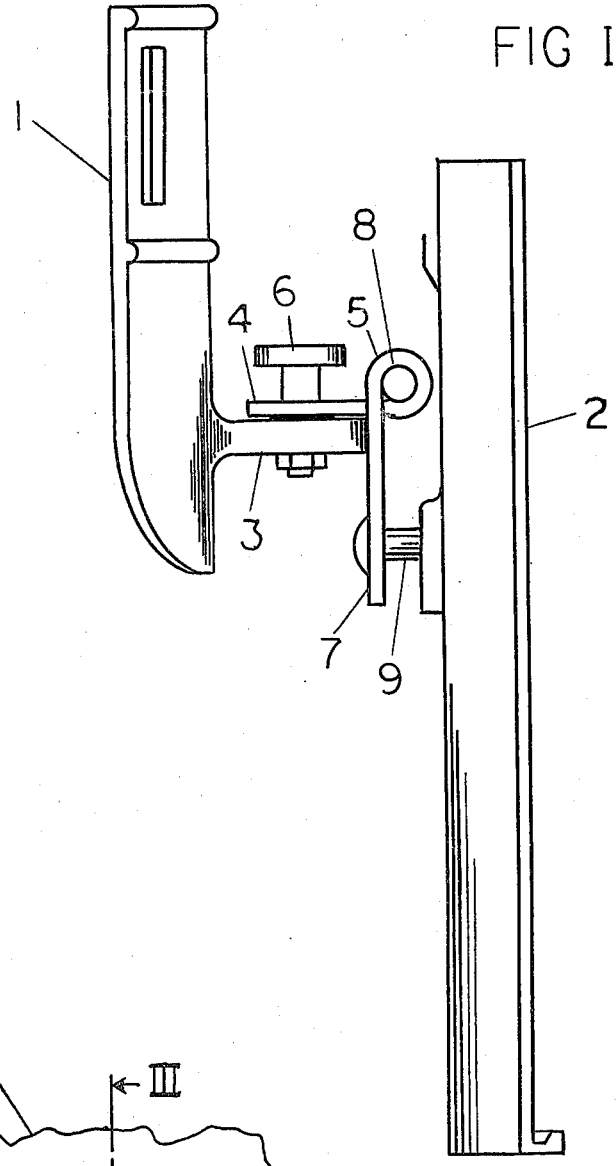
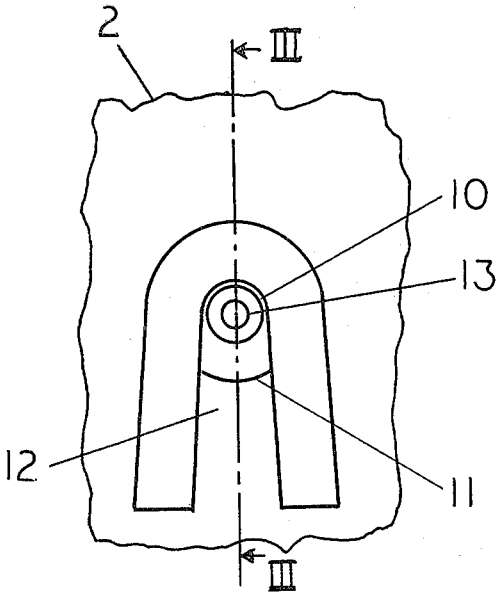
FIG II
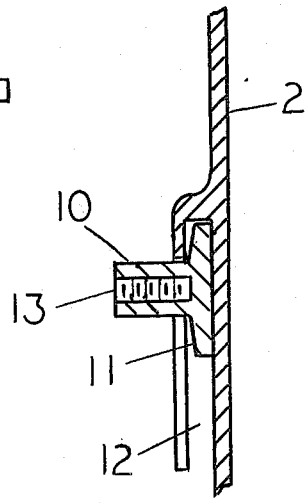
FIG III

PAINTER'S CADDY

This invention is a new and improved PAINTER'S CADDY, and in particular is an improvement over the Painter's Belt-on Brush and Bucket Holder and Carrier described and claimed in my application Ser. No. 225,971, filed on Jan. 21, 1981, now U.S. Pat. No. 4,325,503.

According to the above-identified application, a rack or holder for a paint bucket is linked to a belt-held member in a manner to permit movement about three axes all at right angles to one another so that the bucket is maintained in an upright position under the influence of its own weight and the weight of the paint therein, while the oscillation of the bucket is restrained or damped to avoid sloshing or spilling. The improvement herein is directed to the linking means, modified in a novel manner so as to provide this desired result in a particularly convenient way and to facilitate construction of the article so as to enable greater economy of production.

By the present invention, the belt-held means supported on the body of the user is provided with a horizontally projecting portion which is pivotally connected by a first pivot means to one leaf of a hinge member so that the hinge may be rotated about a vertical axis at the pivot. This leaf of the hinge is connected by a hinge pin to the other leaf which is positioned to hang downwardly and which in turn is pivotally connected to the bucket portion of the invention by a second pivot means for rotation of the bucket about a horizontal axis disposed at a right angle to the axis of the hinge pin.

The first pivotal connection, that of the hinge to the horizontal projection of the belt-held portion, may be by a rivet or bolt, for example. It should be restrainably movable so that while the paint container may be moved forward or rearward to adjust its location without hitching the holder along the belt, its movement is not so free that it would oscillate freely or tend to shift from the selected position. If desired, this first pivot means may comprise an adjustable bolt which can be tightened or loosened to afford the required degree of friction and the bolt or its associated nut may be provided with a knob for ease of hand adjustment.

A second pivot means connects the depending leaf of the hinge to the bucket portion and this also may be a simple rivet or bolt, or may include a detachable means as hereinafter described so that the bucket portion may be taken off and set aside without the need for the painter to remove the belt. The detachable connection is particularly convenient in a further optional modification wherein the paint container and rack are integral, as will also be further herein described.

In FIG. I is shown a side view of one form of the invention illustrating the novel arrangement of the pivot-hinge-pivot linking combination.

FIG. II shows a broken-away area of the paint-carrier portion of the invention to illustrate a modification wherein the said portion may be detachably suspended from the depending hinge leaf.

FIG. III shows a section on the line III—III of FIG. II, to further illustrate this detachable means.

As shown in FIG. I, the belt-held part or hip plate 1 and the paint-carrier part 2 are generally indicated. The novel feature of the belt-held part or hip plate 1 is the fixed horizontally projecting shelf-like member 3; the part 1 may otherwise have any convenient construction, e.g., such as that shown in my patent above referred to or may be molded of a suitable plastic material. The same is true of the paint holding portion 2.

With respect to the details of the novel means for linking the hip plate 1 to the paint holding part 2, as is shown in FIG. I the projecting shelf-like member 3 is attached to one leaf 4 of a hinge 5 by a pivot means 6. Any pivot means may be used, such as a conventional rivet or bolt. Bolt means having a knob or a knurled head for adjusting by hand the frictional resistance of the pivot to movement about its axis is particularly convenient.

The other leaf 7 of hinge 5 is connected to leaf 4 by a usual hinge pin 8 and extends downwardly as shown for pivotal attachment to the paint carrying portion 2, as at pivot 9. The depending leaf 7 bears against the projecting member 3 to restrict its movement toward the wearer; the end of the member 3 is rounded along the circumference of a circle centered at pivot 6 to accommodate rotation of the hinge about the axis of said pivot.

The pivot 9, like pivot 6, may be a conventional rivet or bolt. The frictional resistance to rotation must suffice to prevent free oscillation or swinging of the paint holder. And, as with pivot 6, it is convenient to use a bolt provided with a knob so that the amount of friction is hand-adjustable.

So that the paint carrying portion of the invention can be readily detached from the user without removing the belt-held part or hip plate 1, a pivoted detachable means such as shown in FIGS. II and III may be provided. These figures show part 10 having a flange 11 over which a pocket or recess 12, located on the back of paint holding portion 2, can be slipped to support the paint holding portion on part 10. Part 10 is provided with an internally threaded hole 13 to accommodate a bolt for attaching part 10 to hinge leaf 7. This bolt would thus provide one form of the pivot means 9 described above. When the user of this invention desires to stop painting to rest or perform other work, it is a simple matter to lift the paint carrying structure 2 off part 10 and set aside.

As shown, flange 11 is provided with a taper which results in a tight though readily detachable connection when recessed portion 12 is slipped over it. The recessed portion 12 would normally also have a slight taper, being narrower toward the top, for ease of molding, and this taper can easily be made sufficient to eliminate the need for any taper on the flange 11. It will be observed that the feature of detachability is in itself useful regardless of the exact structure of the linking means; for example, it makes it unnecessary to unstrap a paint can from its carrying rack.

I claim:

1. In apparatus for holding and carrying a container with paint therein on the person of a painter wherein a paint holding part is movably linked to a belt carried part by a linking means which provides for damped and restrained movement of said container to enable it to remain generally upright under the influence of its weight and the weight of the carried paint without sloshing or spilling as the painter moves about, the improvements which comprise a horizontally projecting member on said belt carried part having a rounded end, a hinge having a pair of leaf members relatively rotatable about a hinge pin, one leaf of said hinge being pivotally attached to said horizontally projecting member for rotation in a horizontal plane, the second leaf of said hinge being attached to and depending from said first leaf by said hinge pin for rotational movement in a substantially vertical plane, said second leaf being also pivotally connected to said paint holding part for rotation of the latter in a vertical plane perpendicular to the plane of rotation of said second leaf about the hinge pin, said second leaf being impeded from unrestrained movement toward the wearer by contact with said rounded end of said horizontally projecting member on said belt carried part, at least one of said pivotal connections of said second leaf providing frictional resistance sufficient to damp any tendency of said paint carrying part to freely oscillate.

* * * * *